US008216123B2

(12) United States Patent
Cho et al.

(10) Patent No.: US 8,216,123 B2
(45) Date of Patent: Jul. 10, 2012

(54) IMPLANTABLE MIDDLE EAR HEARING DEVICE HAVING TUBULAR VIBRATION TRANSDUCER TO DRIVE ROUND WINDOW

(75) Inventors: Jin-Ho Cho, Daegu (KR); Il-Yong Park, Cheonan (KR); Ki-Woong Seong, Daegu (KR)

(73) Assignee: Kyungpook National University Industry Academic Corporation Foundation (KR)

( * ) Notice: Subject to any disclaimer, the term of this patent is extended or adjusted under 35 U.S.C. 154(b) by 1026 days.

(21) Appl. No.: 12/175,606

(22) Filed: Jul. 18, 2008

(65) Prior Publication Data

US 2009/0023976 A1 Jan. 22, 2009

(30) Foreign Application Priority Data

Jul. 20, 2007 (KR) ..... 10-2007-0072666

(51) Int. Cl.
*H04R 25/00* (2006.01)

(52) U.S. Cl. ..... 600/25; 381/322

(58) Field of Classification Search ..... 600/25; 607/57; 381/322, 325, 328, 326; 181/135, 181/129, 130, 132, 133, 137, 136
See application file for complete search history.

(56) References Cited

U.S. PATENT DOCUMENTS

| | | | | |
|---|---|---|---|---|
| 3,783,864 | A * | 1/1974 | Moller | 128/864 |
| 4,006,796 | A * | 2/1977 | Coehorst | 181/130 |
| 4,276,449 | A * | 6/1981 | Sawafuji | 381/408 |
| 5,099,947 | A * | 3/1992 | Guggenberger et al. | 181/130 |
| 5,299,176 | A * | 3/1994 | Tibbetts | 367/175 |
| 5,913,815 | A | 6/1999 | Ball et al. | |
| 7,239,069 | B2 * | 7/2007 | Cho | 310/348 |
| 2005/0141739 | A1 * | 6/2005 | Juneau et al. | 381/322 |

* cited by examiner

*Primary Examiner* — John Lacyk
(74) *Attorney, Agent, or Firm* — Daniel A. Thomson; Emerson Thomson Bennett, LLC

(57) ABSTRACT

An implantable middle ear hearing device having a tubular vibration transducer to drive a round window is designed to input sound to a round window opposite an oval window in an inner ear. The tubular vibration transducer has a unique structure that does not attenuate the magnitude of a signal, particularly, in a high frequency band. Sound delivery effect is much higher than those of conventional schemes. It is also possible to minimize difficulties associated with and problems resulting from the operation, which the conventional methods would have. Further, the transducer can have a relatively less compact than ossicle contact type transducers, and thus be easily fabricated. The hearing device can be applied to a sensorineural hearing loss patient with the ossicle damaged. Moreover, since sound is directly transmitted without through the ear drum and the ossicle, high efficiency sound delivery is achievable and hearing loss compensation are easy.

11 Claims, 8 Drawing Sheets

IMPLANTABLE MIDDLE EAR HEARING DEVICE HAVING TUBULAR VIBRATION TRANSDUCER TO DRIVE ROUND WINDOW

CLAIM OF PRIORITY

This application claims the benefit of Korean Patent Application No. 10-2007-0072666 filed on Jul. 20, 2007, in the Korean Intellectual Property Office, the disclosure of which is incorporated herein by reference.

BACKGROUND OF THE INVENTION

1. Field of the Invention

The present invention relates to an implantable middle ear hearing device having a tubular vibration transducer to drive a round window. More particularly, the implantable middle ear hearing device of the present invention is designed to input sound to the round window opposite an oval window in an inner ear using the tubular vibration transducer having a unique structure that does not attenuate the magnitude of a signal, particularly, in a high frequency band.

2. Description of the Related Art

In general, about 15% of the world population has mild to severe hearing loss, and about 1 to 2% of the people with hearing loss cannot hear better using a hearing device that transmits sound through the external ear canal. People with hearing loss wears hearing device inserted into the ear, which makes the people very uncomfortable before they are accustomed to the inserted device. It is also inconvenient to attach or detach the device.

To cope with these problems, some countries such as USA, Japan and Germany have variously researched new types of hearing devices, which can be directly implanted in the temporal bone, since 1980s. Some of these types of implantable hearing devices are commercially used.

The implantable hearing device generally includes a microphone, a device body, which manages signal-processing and controls other components of the device, and a vibrator, which converts electric signals into mechanical vibrations to vibrate an ossicle. Of these components, the vibrator is a miniature device that reproduces sound by directly vibrating a very sensitive portion, such as an ossicle or an opening to a cochlear duct. Thus, the vibrator is regarded as the most important component of a middle ear implantable hearing device.

Various types of vibration transducers, which have been researched and developed up to the present, can be divided into an electromagnetic vibrator type and a piezoelectric vibrator type.

Of these vibrators, the piezoelectric vibrator transmits vibration by installing an anchor in the outer wall of the middle ear cavity such that one end of the piezoelectric bimorph comes in contact with an ossicle such as a stapes. This scheme, which was first proposed by Yanagihara, professor of Ehime University, Japan, has been widely adopted by various models such as Envoy by St. Croix Medical (USA) and TICA by Implex AG (Germany). Related patents include, for example, U.S. Pat. No. 6,726,618, U.S. Pat. No. 6,585,637 and U.S. Pat. No. 6,540,662.

However, this scheme has drawbacks in that the operation of implanting a piezoelectric transducer inside a middle ear cavity is complicated and time consuming.

A transducer using the electromagnetic vibrator has been commercially distributed by the proposal of Ball of Symphonix Devices, Inc. of USA. This type of transducer may include a so-called floating mass transducer, which is fitted to the incus of the ossicle using a clamp, and related patents are, for example, U.S. Pat. No. 5,800,336 and U.S. Pat. No. 5,913,815.

However, the electromagnetic vibrator type transducer can be implanted only in the presence of the ossicle, and has to be clamped for a long time, which may disadvantageously burden the ossicle.

In 1994, Spindel et al. proposed an implantable hearing device, in which a miniature permanent magnet is installed in an opening of the round window opposite the oval window (i.e., a connecting aperture) by the side of the external auditory ear canal maintained as it is, and an electronic coil for generating a magnetic field in response to a voice signal current is installed by the side of the mastoid, so as to transmit sound.

However, this scheme has drawbacks of poor practicability. Due to the relatively large distance between the electronic coil and the permanent magnet in the round window, a considerably large signal current is applied, thereby increasing the consumption of battery power.

In addition, US Patent Application Publication No. 2005/0020873 was proposed by Berrang et al. in 2005. As disclosed by this document, a vibrator is implanted in the bone above a vestibular organ adjacent to the inner ear, and includes a cylindrical housing and a multilayer piezoelectric structure, which has a diameter from 2 mm to 6 mm and is encased in the housing.

This scheme proposes another type of implantable hearing device, which designed based on a bone conduction mechanism. This type of implantable hearing device stimulates a region adjacent to the inner ear using a miniature vibrator in order to prevent a problem of attenuation by bone, which is caused by a preexisting bone conduction hearing device that stimulates the temporal bone using a bone conduction vibrator.

However, this scheme inevitably consumes a large amount of energy compared to the hearing device of Symphonix, Otologics, and St. Croix medical implantable middle hearing aid. Thus, it is not advantageous to apply this scheme to the middle ear implantable hearing device that has limited battery capacity.

In 1991, Engebreison et al. proposed a hearing device, which includes a totally-implantable middle ear body, an implantable microphone connected to the implantable middle ear body via an air tube instead of electric cords and a sound delivery coupler. With regard to the construction of this device, an implantable microphone is connected, through a tube, to a sound pickup coupler formed of a Titanium membrane, which is in contact with the malleus behind the ear drum. For sound output, a sound delivery coupler formed of a Titanium membrane is connected to the stapes through a tube, so as to transmit sound.

As peculiar characteristics of this device, the sound coupler is connected to the distal end of each tube so as to transmit sound pressure from the ear drum to the microphone inside the device body, and from the receiver inside the device body to the stapes. In fact, the application of the tube to transmit sound for higher sound transmission efficiency has been used in a process of inserting the tube into an earmold by connecting to the output of the receiver of a Behind The Ear (BTE) hearing device. Therefore, the application of the tube cannot be regarded as an inventive concept of this device.

When this device is realized as an actual middle ear implantable hearing device, there are drawbacks as follow.

Firstly, the structure of each sound coupler is too complicated, so that a miniature sound coupler cannot be easily fabricated or welded, thereby increasing manufacturing costs. This structure also requires very complicated and difficult processes, such as welding a small connector loop to the center of the membrane of a very thin Titanium film and hermetically sealing the entire structure.

Secondly, as another drawback of the hearing device of Engebreison et al., the ossicle of a patient should be cut such that an output from the receiver is not feed back to an adjacent sound coupler of the microphone.

Thirdly, the microphone and the microphone coupler should be prepared separately and the receiver and the receiver coupler should be set separately. Accordingly, the device is more bulky and complicated.

Fourthly, since the length of the sound tube connected to the receiver inside the body is increased to 5 cm or more, sound is generally attenuated, and especially, a high frequency range is significantly attenuated. Accordingly, this structure fails to provide clear sound to the user.

Fifthly, sound from the receiver is transmitted along the tube to vibrate the sound coupler membrane, which in turn vibrates the stapes. In view of the anatomical structure of the middle ear, the membrane of the sound coupler of the stapes cannot be sufficiently enlarged. Therefore, the sound coupler of the stapes does not greatly decrease high frequency transmission characteristics but greatly decreases low frequency transmission characteristics.

In 1993, Gilman was proposed another style of implantable hearing aid (U.S. Pat. No. 5,176,620) which using long liquid filled tube. In this method, a liquid filled tube is positioned between an orifice of cochlear and a subcutaneous receiver connected to amplifier. However, this method has same limitations as point out in the Engebreison et al.'s method, due to they use long liquid tube which severely reduces high frequency response. And Gilman conceptually proposed sound generator as a large size block in the drawing, but there were no explanation about the principle and mechanism of the receiver.

Recently, Vibrant MeDEL proposed another surgical scheme such as SoundBridge model, in which a floating mass vibrator by Ball et al. is wrapped in a fascia and a vibrator surface is brought into contact with the round window membrane. However, a relatively large region adjacent to the opening of the round window has to be cut in order to implant the vibrator having a diameter 2 mm in the cut region. Further, since the vibrator has to be fixed using only the fascia, it is difficult to guarantee that the vibrator stably remain in position for a long time after the operation.

The fixing process is insecure, and this scheme is rarely applicable to patients having severe hearing loss since the maximum driving force of the vibrator is dependent on the maximum driving force of the floating mass vibrator.

According to the paper by K. B. Huttenbrink of Germany, Otolaryngologic Clinic of North America, Vol. 34, No. 2, 2001, a piezoelectric vibrator having a housing is installed inside the squama tempolaris or the mastoid cavity of the skull, and a tube is connected from an output of the vibrator to the round window. This report proposed, for the first time, a method of using a balloon made of a thin film at the end of the tube when the tube is introduced into the round window.

Regarding that the vibrator is present inside the temporal bone rather than inside the tube, the general concept of this paper is similar to that proposed by Engebrison et al., in 1991, described as above. The tube is connected from the vibrator inside the temporal bone to the vibration-transmitting point along a long path. Therefore, a great amount of sound attenuation and distortion is followed, and the temporal bone has to be cut in when the operation is performed.

While this report proposed a concept that prepares a vessel having a thin film such as a balloon on the distal end of the tube and fills fluid into the vessel, details such as a shape, dimensions or material are not disclosed at all. The tube distal end of Huttenbrink disclosed by the document is configured as a balloon of a thin film, which exerts force in every direction and suspends from the preexisting tube. This configuration, however, may cause loss to the transmission of pressure.

SUMMARY OF THE INVENTION

The present invention has been made to solve the foregoing problems with the prior art, and therefore the present invention is directed to an implantable middle ear hearing device having a tubular vibration transducer to drive a round window. Unlike the conventional methods, which transmit sound to an oval window through an ear drum and an ossicle, the implantable middle ear hearing device of the present invention inputs sound to the round window by providing a tubular transducer having a miniature vibrator stored inside a tubular member so as to minimize the attenuation of a signal, particularly, in a high frequency band, thereby remarkably simplifying an incising operation of a temporal bone, which is necessary in the conventional tubular middle ear implantable hearing device.

According to an aspect of the present invention, the middle ear implantable hearing device includes a microphone detecting sound from outside; a signal processing unit amplifying the sound received from the microphone; a hollow tubular member with a first portion thereof coupled to the signal processing unit and a second portion thereof inserted into an opening of a round window in an inner ear of a human body; a vibrating unit disposed inside the tubular member so as to generate mechanical vibration signals or sound signals in response to electric signals from the signal processing unit; and a signal cord disposed inside the tubular member, wherein the signal cord is connected, at a first end portion thereof, to the signal processing unit, and at a second end portion thereof, to the vibrating unit so as to transmit the electric signals from the signal processing unit to the vibrating unit.

The tubular member may include a cord-storing part housing the signal cord therein, a vibrator-storing part integrally extending from the cord-storing part, and a vibration-transmitting part integrally extending from the vibrator-storing part.

Here, the vibration-transmitting part may have an aperture at a distal end thereof, and the tubular member may further include a porous filter placed inside from the aperture so as to prevent foreign materials from entering.

The vibration-transmitting part may have a close flared distal end, which is so configured to allow air or liquid to enter.

The vibration-transmitting part may have an open flared distal end, and the tubular member may further include a porous filter placed inside the distal end so as to prevent foreign materials from entering.

Further, the vibration-transmitting part may have a tapered cross-sectional shape that narrows to the distal end.

Further, the vibration-transmitting part may further have a funnel-shaped bushing polymer ring on the distal end, the bushing polymer ring being flexible and biocompatible.

The vibrating unit may include a housing disposed inside the tubular member and having a through-hole in a first end thereof, through which the signal cord is inserted; first and second electrodes disposed inside the housing and connected to the signal cord; at least one layer of piezoelectric element disposed between the first and second electrodes; a diaphragm coupled to a second end of the housing so as to be vibrated by the piezoelectric element; and vibration-transmitting member disposed between the piezoelectric element and the diaphragm so as to transmit vibration from the piezoelectric element to the diaphragm.

The vibrating unit may include a housing disposed inside the tubular member; a coil wound on an inner circumferential portion of the housing and connected to the signal cord; a pair of opposing magnetic members disposed inside the housing; a vibration-controlling membrane coupled to a first end of the magnetic member; a diaphragm coupled to a first end of the housing so as to vibrate in response to a pair of the magnetic members; and a vibration-transmitting member interposed between the magnetic member and the diaphragm so as to transmit vibration, generated by the coil and the magnetic members, to the diaphragm.

Here, the diaphragm may have a corrugated part in a circumferential portion thereof so as to amplify vibration.

As set forth above, the middle ear implantable hearing device of the present invention directly transmits sound vibration in response to the vibration of the miniature transducer stored inside the tubular member without through the ear drum and the ossicle, so that high efficiency sound delivery is achievable and hearing loss compensation are easy.

BRIEF DESCRIPTION OF THE DRAWINGS

The above and other objects, features and other advantages of the present invention will be more clearly understood from the following detailed description taken in conjunction with the accompanying drawings, in which:

FIGS. 2A to 2C are schematic views illustrating some embodiments of the implantable middle ear hearing device of the present invention, wherein:

FIG. 2A illustrates an embodiment of the implantable middle ear hearing device, in which a porous filter is provided in the distal end of a vibration-transmitting part of a tubular member, FIG. 2B illustrates another embodiment of the implantable middle ear hearing device, in which the distal end of the vibration-transmitting part of the tubular member has a flared shape, and FIG. 2C illustrates a further embodiment of the implantable middle ear hearing device, in which the distal end of the vibration-transmitting part of the tubular member has a flared shape and a porous filter is provided in the distal end of the vibration-transmitting part;

DETAILED DESCRIPTION OF THE EXEMPLARY EMBODIMENTS

Hereinafter, an implantable middle ear hearing device having a tubular vibration transducer to vibrate a round window according to the present invention will be described more fully with reference to the accompanying drawings, in which exemplary embodiments thereof are shown.

Figure 1:
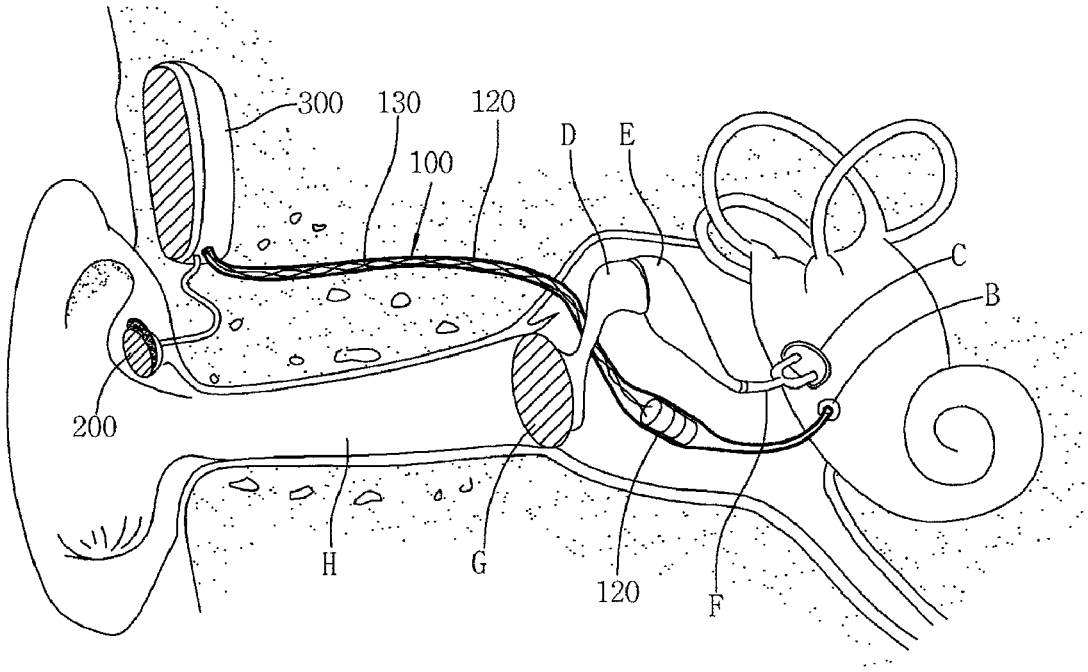
FIG. 1 illustrates the structure and operation principle of a middle ear implantable hearing device having a tubular vibration transducer to vibrate a round window according to an embodiment of the present invention.

Of the accompanying drawings, FIG. 1 illustrates the structure and operation principle of an implantable middle ear hearing device having a tubular vibration transducer to vibrate a round window according to an embodiment of the present invention.

Firstly, the basic structure of the implantable middle ear hearing device according to an embodiment of the present invention will be described with reference to FIG. 1.

The implantable middle ear hearing device 100 of this embodiment includes a tubular member 110, a vibrating unit 120 and signal cords 130. The hearing device 100 cooperates with a microphone 200, which is attached to an ear of a user in order to detect sound from outside, and a signal processing unit 300, which is implanted under the skin of a temporal bone to perform signal processing, for example, amplify sounds from the microphone 200.

The tubular member 110 is a flexible hollow member, which is coupled, at one end thereof, to the signal processing unit 300, and is inserted, at the other end, into the entrance of a round window B. The tubular member 110 includes a signal cord-storing part 111 housing the signal cords 130 therein, a vibrator-storing part 112 integrally extending from the signal cord-storing part 111 and a vibration-transmitting part 113 integrally extending from the vibrator-storing part 112. The vibration-transmitting part 113 may preferably have a tapered cross section, in which the inside diameter thereof decreases to the distal end thereof. In conventional implantable middle ear hearing device using a tube, the large distance between a vibrating part and a vibrated part causes to attenuate vibration and also to degrade high frequency characteristics. On the contrary, since the present invention adopts a miniature vibrator that is small enough to be stored in the tube, the vibrating unit 120 can be disposed inside the tubular member 110, and thus be located right beside the round window B. Accordingly, this construction can attribute to prevent the tube from contracting or being distorted and simplify surgical procedures.

The vibrating unit 120 is provided inside the vibrator-storing part 112 of the tubular member 110, so as to generate mechanical vibration signals or sound signals in response to electric signals applied from the signal processing unit 300. The vibrating unit 120 can be implemented as, but is not limited to, a piezoelectric vibrator or an electronic vibrator. Rather, the vibrating unit 120 may be implemented as any type of miniature vibration transducer that has a cylindrical shape and high performance.

The signal cords 130 are lead wires, which are provided inside the signal cord-storing part 112 of the tubular member 110, so as to transmit electrical signals from the signal processing unit 300 to the vibrating unit 120.

The principle and detailed construction of the implantable middle ear hearing device of the present invention will be described more fully hereinafter.

According to a conventional scheme by Engebresion et al., a receiver of a hearing device is inserted into a signal processing unit 300, a tube is connected from a body of the signal processing unit 300 to the stapes F of the ossicle, and a membrane in the form of a cylindrical drum on the distal end of the tube is brought into contact with the ossicle such as the stapes F.

In this case, sound is delivered from the signal processing unit 300 to the distal end of the tube before being transmitted to the stapes F. When sound is entering the oval window C through the tubular member 110 having a length of about 5 cm, overall gain and, especially, high frequency gain of sound can be decreased greatly. When the tube acting as a sound canal is made thinner, acoustical attenuation may increase.

In the middle ear implantable hearing device 100 of this embodiment, the vibrating unit 120 having a length less than 3 mm is inserted into the flexible tubular member 110, which has an outside diameter 3 mm and an inside diameter less than 2 mm, such that the length of insertion becomes 10 mm to 20 mm from the distal end of the tubular member 110, and then the distal end of the vibration-transmitting member 113 is introduced to the opening of the round window B. Since the tubular member 130 with the signal cords 130 stored therein replaces the conventional tube acting as a sound canal, the tubular member 130 can properly act even if it is made very thin. Accordingly, a very advantageous structure for implantation can be achieved.

In the conventional hearing device by Ball et al. or the piezoelectric type hearing device, sound vibration is transmitted to the ossicle. When the incus E is alive, acoustic radiation resistance, produced by the stapes F, the incus E, the malleus D, the tympanic membrane G and ligaments supporting these bones together with the vibration of these components, acts as load. Further, acoustic attenuation also occurs when the tube is surrounded by the bone or is brought into contact with another tissue.

In the case of the middle ear implantable hearing device 100 of this embodiment, vibrating force generated by the vibrating unit 120 is wholly transmitted to the membrane of the round window B. The efficiency of the hearing device 100 of this embodiment is much higher than that obtained by the conventional schemes, in which only a portion of vibrating force enters the oval window C after being lost by several related components.

In the conventional art, an implantable microphone is installed in the center of the external auditory ear canal H as in the Totally Integrated Cochlear Amplifier (TICA) type middle ear implantable hearing device, a microphone is installed in the body of the signal processing unit 300 or the mastoid as proposed by Otologics, or the incus is removed and the ear drum is used as a microphone as in the Envoy model of St. Croix Medical.

In the case where the microphone is installed in the center of the external auditory ear canal, a sound feedback channel to the microphone is formed when energy produced from the vibration of the vibrator is radiated through the ear drum and then through the external auditory ear canal. As is known in the art, this scheme has failed since strong sound is inevitably produced. In the case where the microphone is installed in the body of the signal processing unit 300 or in the mastoid of the temporal bone, a gain about 3 dB, which is produced by a sound collecting effect by the auricle, has to be abandoned. It is also inconvenient since noise may enter the microphone when the wearer is sleeping or leaning against a sofa.

In the case where the incus is removed and the ear drum is used as the microphone, the vibrator and the ear drum coexist in the limited middle ear cavity, so that a sound radiation effect may occur with a high probability in a high frequency range, thereby making it difficult to enable a high gain operation. Therefore, a signal processor, which has an adaptive feedback removing algorithm, is essentially required. As a drawback, however, a battery is quickly consumed.

In order to cope with these problems, in this embodiment of the present invention, the miniature microphone having a thickness less than 5 mm and a diameter less than 8 mm is implanted under the skin in the cavum concha inside the auricle or in the temporal bone rather than in the external auditory ear canal H, such that the membrane of the microphone can easily respond to sound entering in a direction perpendicular to the plane of the skin.

Figure 2A:
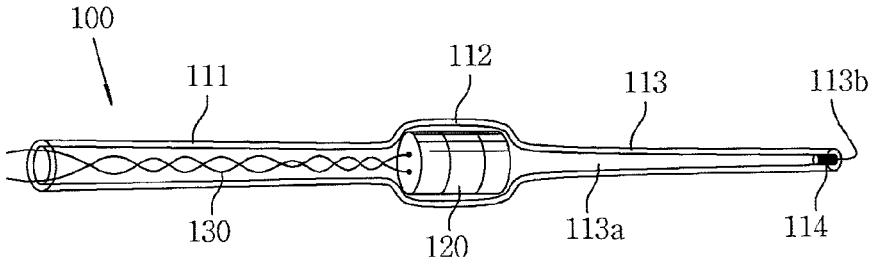
Figure 2B:
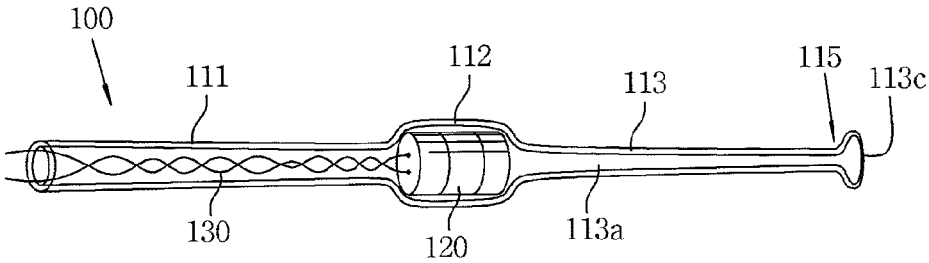
Figure 2C:
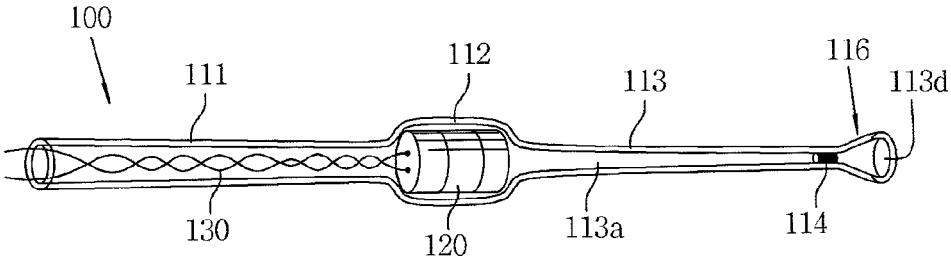

Of the accompanying drawings, FIGS. 2A to 2C are schematic views illustrating some embodiments of the middle ear implantable hearing device of the present invention. That is, FIG. 2A illustrates an embodiment of the middle ear implantable hearing device, in which a porous filter is provided in the distal end of a vibration-transmitting part of a tubular member, FIG. 2B illustrates another embodiment of the middle ear implantable hearing device, in which the distal end of the vibration-transmitting part of the tubular member has a flared shape, and FIG. 2C illustrates a further embodiment of the middle ear implantable hearing device, in which the distal end of the vibration-transmitting part of the tubular member has a flared shape and a porous filter is provided in the distal end of the vibration-transmitting part.

FIGS. 2A to 2C show respective middle ear implantable hearing devices 100, each of which is embodied by inserting the miniature vibrating unit 120 having a length less than 3 mm into the flexible tubular member 110 having an outside diameter 3 mm and an inside diameter less than about 2 mm, particularly, into an inside portion of the tubular member 110 distanced about 10 mm to 20 mm from the distal end of the tubular member 110.

When an electrical signal is received from the signal processing unit 300, the vibrating unit 120 generates sound vibration to the right. Sound pressure increases to the right since the vibration-transmitting part 113 of the tubular member 110 acting as a sound path has a tapered shape that decreases in diameter to the right.

This is achieved using the fact that fluid pressure such as sound pressure increases in response to decrease in the cross section of the tubular member 110. For example, when two separated points in one tube have areas A1 and A2 and fluid pressures P1 and P2, respectively, the principle $A1 \times P1 = A2 \times P2$ is applied from the continuity equation of fluid. Thus, sound pressure increases ($P2 >> P1$) in response to decrease in the cross section of the tubular member 110 (i.e., $A1 < A2$).

The tubular member 110 may preferably be a flexible biocompatible polymer pipe, and alternatively be a biocompatible metal pipe.

The diameter of the vibrating unit 120 may further be reduced, such that the vibrator-storing part 112 of the tubular member 110 does not bulge unlike the illustration of the drawings. Conversely, a relatively larger one of the vibrating unit 120 may be installed in the vibrator-storing part 112 in order to generate a large amount of driving force, which is required for people with severe hearing loss. This construction can advantageously produce a sufficient amount of output power that cannot be produced by the sound bridge model of MedEL, in which the vibrating unit 120 is directly installed in the round window B without being installed in the vibrator-storing part 112.

The vibrating unit 120 may be implemented as, but is not limited to, a piezoelectric vibrator or an electronic vibrator. Rather, the vibrating unit 120 may be implemented as any type of miniature vibration transducer that has a cylindrical shape and high performance.

FIG. 2A shows the middle ear implantable hearing device in which a porous filter 114 is provided in the distal end of the vibration-transmitting part 113 of the tubular member. Specifically, the vibration-transmitting part 113 has an aperture 113*b* at the distal end thereof, and the porous filter 114, which prevents foreign materials such as dirt from entering, is installed inside the aperture 113*b*.

The aperture 113*b* is open, the air can flow through the inner space of the vibration-transmitting part 113, and the porous filter 114 serves to prevent foreign materials such as dirt or body fluids from entering.

The signal cord-storing part 111 of the tubular member 110 is covered with a coat, which may be made of the same material as or be much thinner than the vibration-transmitting part 113.

FIG. 2B illustrates the middle ear implantable hearing device, in which the distal end of the vibration-transmitting part 113 of the tubular member 110 has a flared shape. Specifically, the vibration-transmitting part 113 has a flare-shaped part 115 at the distal end thereof, through which the air or liquid can enter.

The inner space of the vibration-transmitting part 113 may be filled with liquid such as water or oil so as to advantageously transmit the air or sound pressure. The distal end of the vibration-transmitting part 113 may be formed as a polymer membrane surface 113*c*, which is made of silicone, polyurethane or the like with a thickness of approximately from 10 μm to 100 μm. The polymer membrane surface 113*c* can be formed by an injection process. Preferably, the area of the polymer membrane surface 113*c* is similar to that of the round window membrane concealed under the round window niche.

FIG. 2C illustrates a middle ear implantable hearing device, in which a porous filter 114 is provided at the distal end 113*d* of the vibration-transmitting part 113 of the tubular member 110 having a flared shape. Specifically, an opened flare-shaped part 116 is provided at the distal end 113*d* of the vibration-transmitting part 113, and the porous filter 114 is provided inside the distal end 113. The porous filter 114 is bonded using biocompatible adhesive having fine quality.

Figure 3:
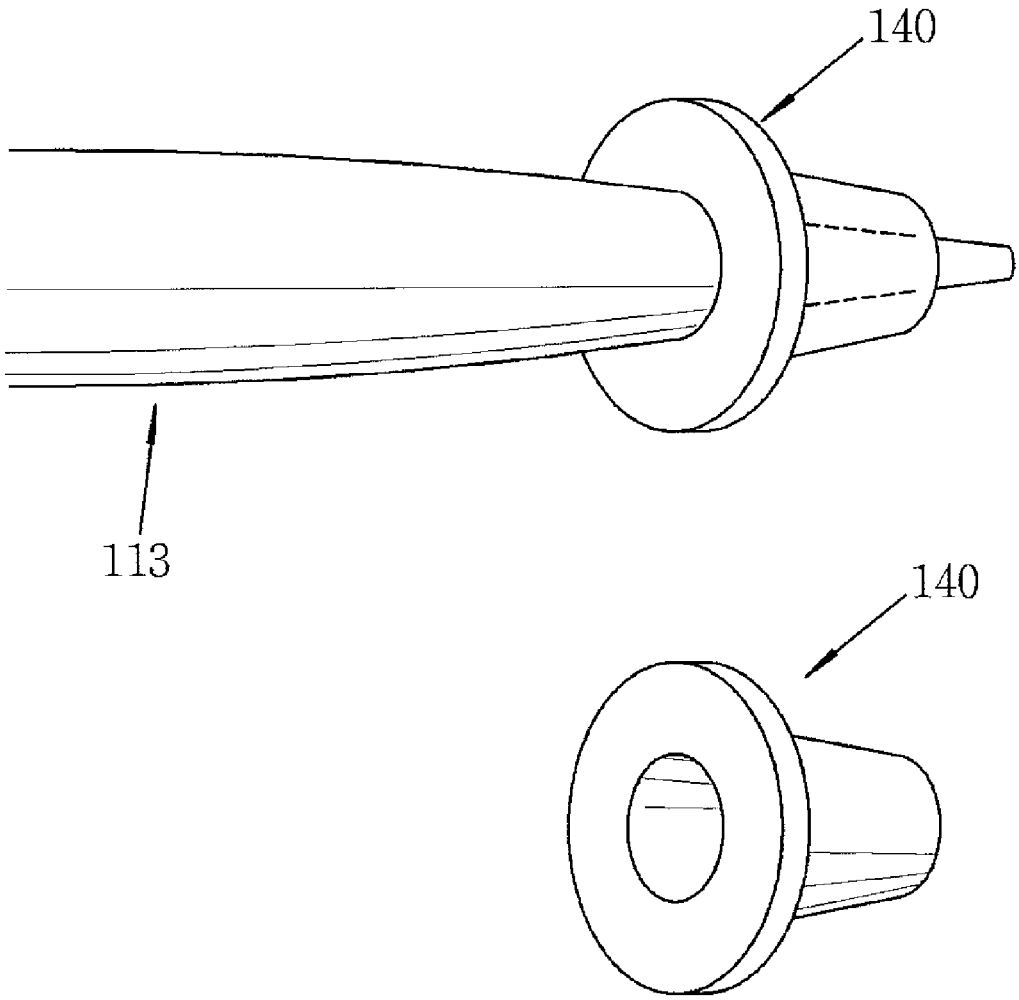
FIG. 3 is a schematic perspective view illustrating the coupling structure between the vibration-transmitting part shown in FIG. 2A and a bushing polymer ring according to the present invention.
Figure 4:
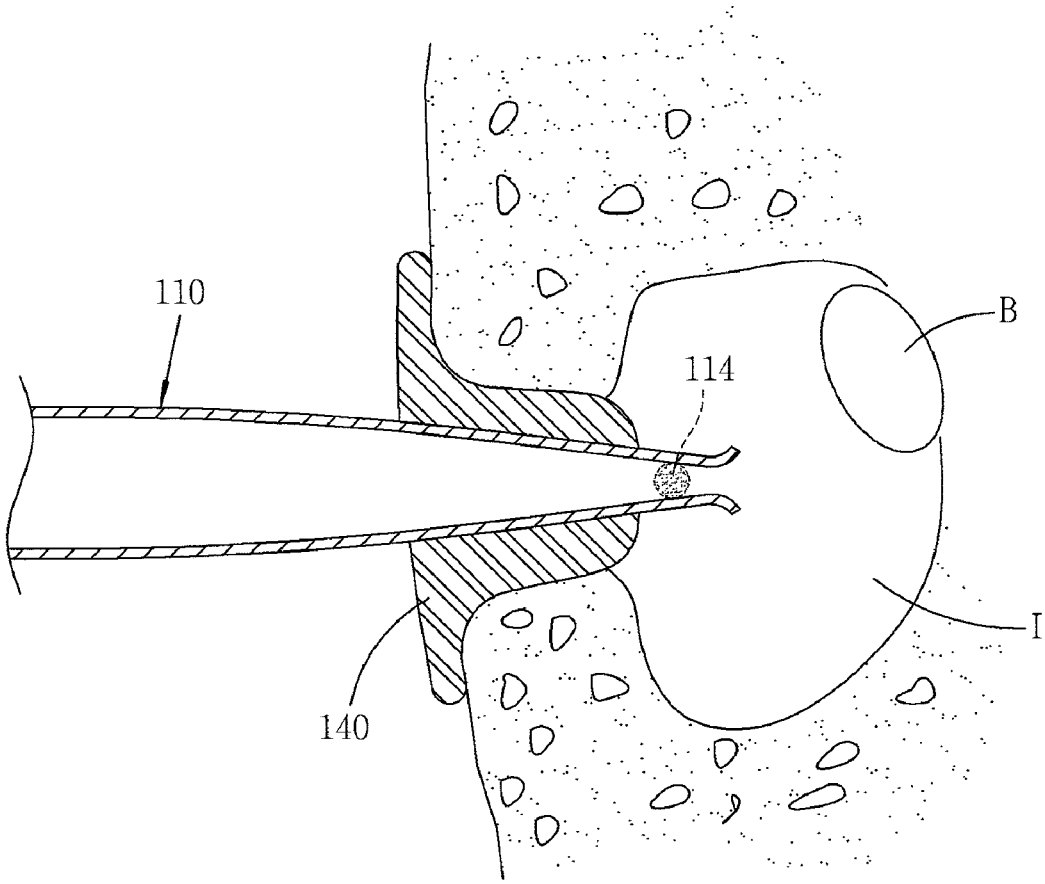
FIG. 4 is a schematic cross-sectional view illustrating the coupling state of the round window and the bushing polymer ring, in which the vibration-transmitting part shown in FIG. 2A is used.
Figure 5:
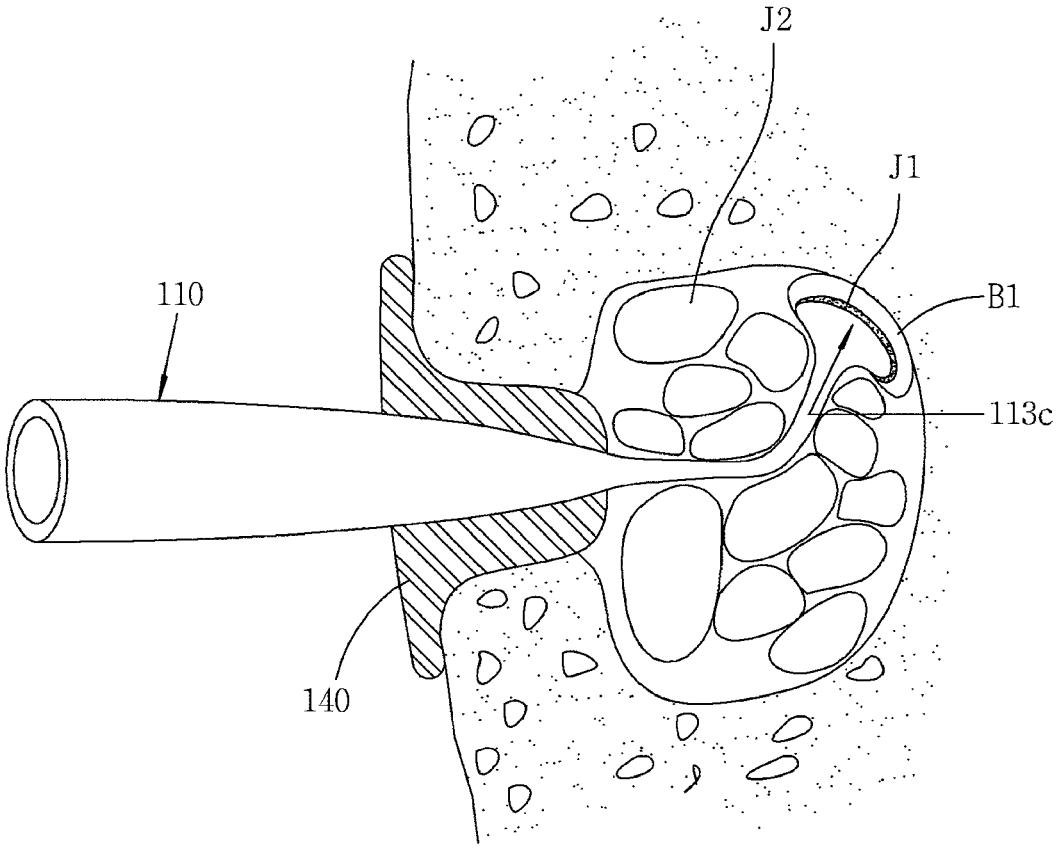
FIG. 5 is a schematic cross-sectional view illustrating the coupling state of the round window and the bushing polymer ring, in which the vibration-transmitting part shown in FIG. 2B is used.

Of the accompanying drawings, FIG. 3 is a schematic perspective view illustrating the coupling structure between the vibration-transmitting part shown in FIG. 2A and a bushing polymer ring according to the present invention, FIG. 4 is a schematic cross-sectional view illustrating the coupling state of the round window and the bushing polymer ring, in which the vibration-transmitting part shown in FIG. 2A is used, and FIG. 5 is a schematic cross-sectional view illustrating the coupling state of the round window and the bushing polymer ring, in which the vibration-transmitting part shown in FIG. 2B is used.

Referring to FIG. 3, the distal end of the vibration-transmitting part 113 is coupled with a funnel-shaped bushing polymer ring 140, which is flexible and biocompatible.

This construction allows the end of the tapered vibration-transmitting part 113 of the tubular member 110 to be easily inserted into an opening of the round window B. The bushing polymer ring 140 may preferably having an outside diameter approximately from 3.5 mm to 7 mm and a length approximately from 4 mm to 7 mm. Further, a coat portion covering the tubular member 110 may be formed with an inside diameter similar to the outside diameter of the tubular member 110 and a thickness approximately from 1 mm to 3 mm so as to be finely supported when elastically inserted into the opening of the round window B.

Referring to FIG. 4, the middle ear implantable hearing device having the porous filter in the distal end of the vibration-transmitting part as shown in FIG. 2A is coupled to the round window. The opening of the round window niche is drilled to a size approximately from 2 mm to 5 mm so as to form a small cavity I including a round window membrane therein, and an opening part of the tubular member 110 including the bushing polymer ring 140 can be inserted, under pressure, into the drilled opening of the round window such that the tubular member 110 does not slip away from the round window due to the elasticity thereof.

Referring to FIG. 5, in the middle ear implantable hearing device, the vibration-transmitting part having the flared distal end shown in FIG. 2B is coupled into the round window.

In this case, the round window membrane B1 is covered with a thin and round fascia J1 and the hollow space is filled with other fasciae J2 such that the polymer membrane surface 113*c* at the flared distal end, which transmits sound pressure vibration, can come into smooth-contact with the round window membrane B1, and at the same time, biocompatible coupling can be finely maintained. Accordingly, the tubular member 110 can be nested in position without shaking or swerving and the polymer membrane surface 113*c* can come into contact with the round window membrane B1.

Figure 6A:
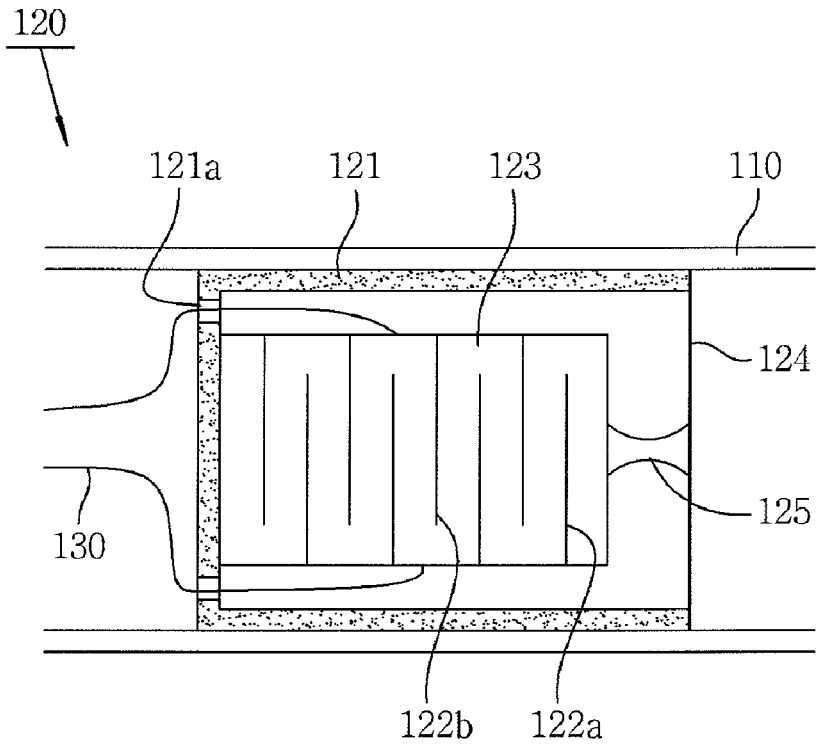
FIGS. 6A and 6B are schematic views illustrating the structure of an embodiment of the vibrating unit according to the present invention.
Figure 6B:
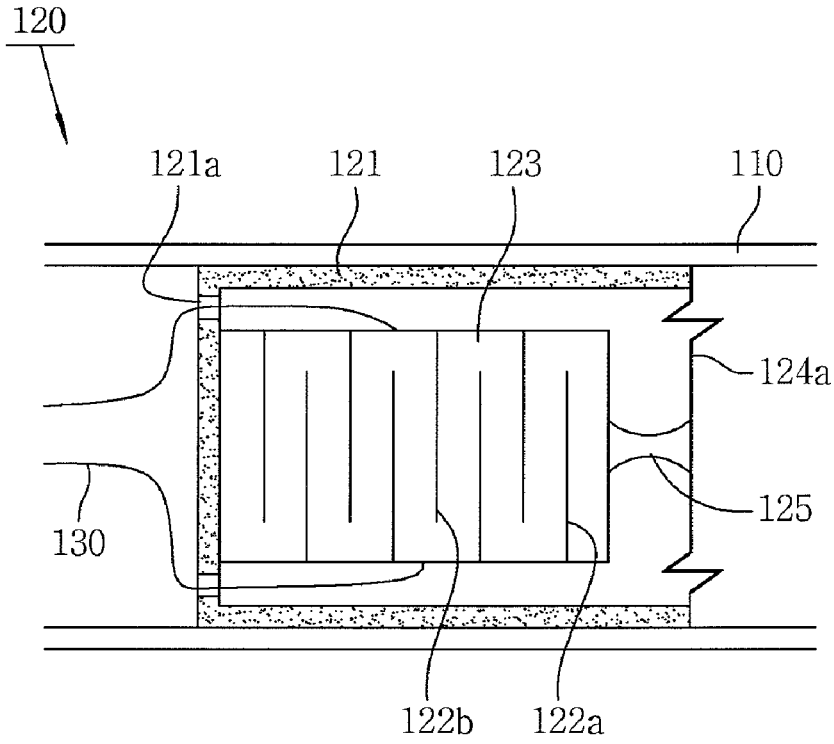
Figure 7A:
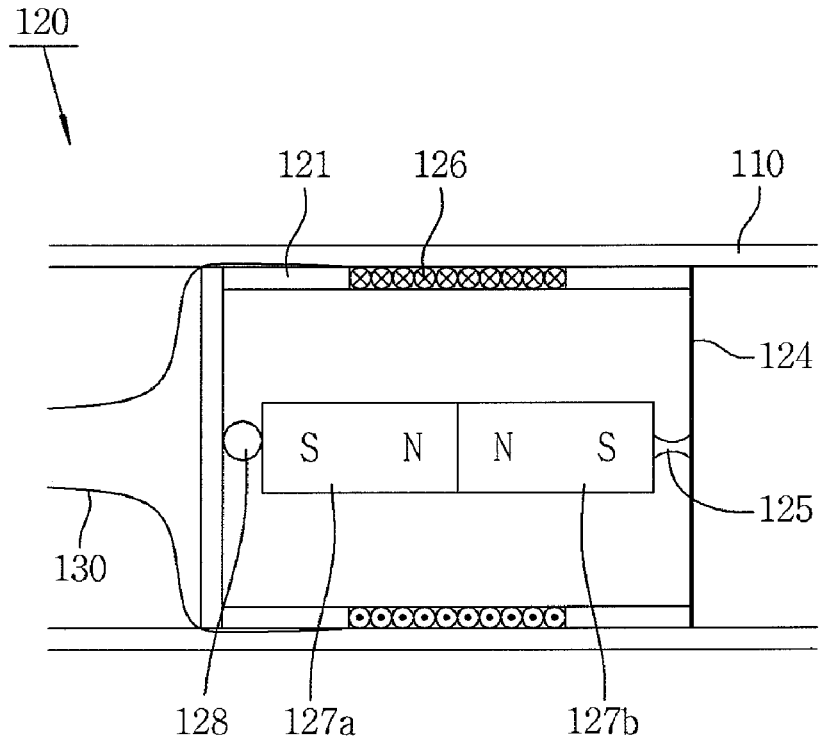
FIGS. 7A and 7B are schematic views illustrating the structure of another embodiment of the vibrating unit according to the present invention.
Figure 7B:
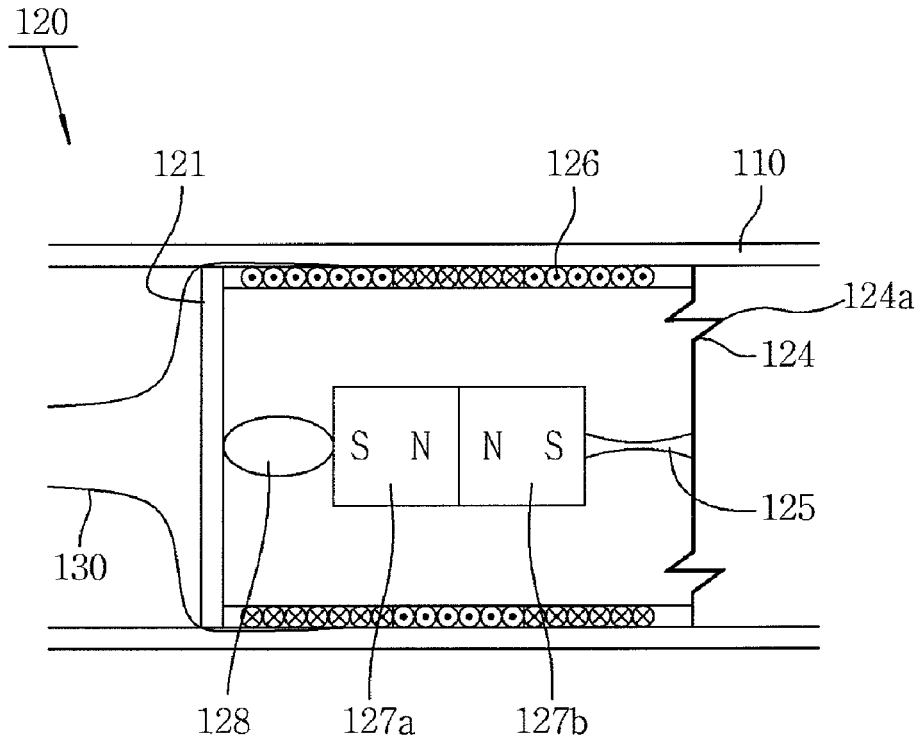

FIGS. 6A and 6B are schematic views illustrating the structure of an embodiment of the vibrating unit according to the present invention, and FIGS. 7A and 7B are schematic views illustrating the structure of another embodiment of the vibrating unit according to the present invention. In the drawings, the same or similar elements with denoted by the same reference numerals even though they are depicted in different drawings.

Referring to FIGS. 6A and 6B, the vibrating unit 120 is implemented as a piezoelectric vibrator. The vibrating unit 120 includes a housing 121 disposed inside the tubular member 110 and first and second electrodes 122*a* and 122*b* disposed inside the housing 121 and connected to the signal cords 130. The housing 121 has a through-hole 121*a* in one end thereof, through which the signal cords 130 are inserted into the housing 121, and the first and second electrodes 122*a* and 122*b* alternate with each other in a zigzag shape. The vibrating unit 120 also includes at least one layer of piezoelectric element 123 disposed between the first and second electrodes 122*a* and 122*b*, a diaphragm 124 coupled to the other end of the housing 121 so as to be vibrated by the piezoelectric element 123 and a vibration-transmitting member 125 disposed between the piezoelectric element 123 and the diaphragm 124 so as to transmit vibration from the piezoelectric element 123 to the diaphragm 124.

The signal cords 130 are connected to the first and second electrodes 122*a* and 122*b* through the through-holes 121*a* of the housing 121. The through-holes 121*a* can be preferably formed of such a size that the signal cords 130 can easily pass through.

As shown in FIG. 6B, the diaphragm 124 has a corrugated part 124*a* in the outer circumference thereof so as to amplify vibration that the piezoelectric element 123 generates.

In the vibrating unit 120 as constructed above, the piezoelectric element 123 vibrates in response to the first and second electrodes 122*a* and 122*b*, and the vibration-transmitting member 125 transmits the vibration from the piezoelectric element 123 to the diaphragm 124, such that maximum of vibration energy can be transmitted to the right.

Referring to FIGS. 7A and 7B, the vibrating unit 120 is implemented as a differential electronic transducer so as not to be affected by external magnetic fields. The vibrating unit 120 includes a housing 121, which is made of hermetic material such as Titanium and is disposed inside the tubular member 110. The vibrating unit 120 also includes a coil 126 wound on the inner circumference of the housing 121 and connected to the signal cords 130, a pair of opposing magnetic members 127*a* and 127*b* disposed inside the housing 121, a vibration-controlling membrane 128 coupled to one end of the magnetic member 127*a*, a diaphragm 124 coupled to one end of the housing 121 so as to vibrate in response to a pair of the magnetic members 127*a* and 127*b* and a vibration-transmitting member 125 interposed between the magnetic member 127*b* and the diaphragm 124 so as to transmit vibration, generated by the coil 126 and the magnetic members 127*a* and 127*b*, to the diaphragm 124.

The magnetic members 127*a* and 127*b* are oriented in such a manner that N poles face each other in the center and S poles are arranged outside.

As shown in FIG. 7A, the coil 126 and the magnetic members 127*a* and 127*b* cooperate with each other to generate a force according to the following formula:

$$F=B\times I,$$

where F is force, B is a magnetic field generated by the magnetic members, and I is electric current flowing through the coil 126. The force F is obtained using a cross product of electric current flowing through the coil 126 on the middle portion of the housing 121 and magnetic lines of force from the N poles of the magnetic members 127*a* and 127*b*, and acts as a source to produce vibration.

Figure 7C:
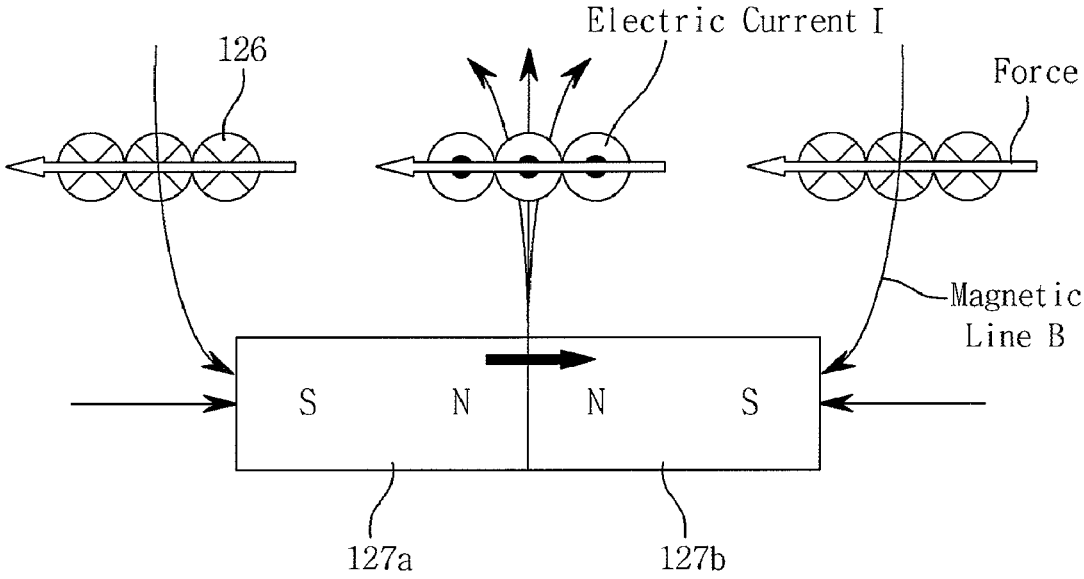
FIG. 7C illustrates the direction of magnetic lines of force, electric currents and a resultant force, generated by the coil and the magnetic members of the vibrating unit shown in FIGS. 7A and 7B.

However, as shown in FIG. 7C, the coil 126 can be divided into three parts in order to produce strong vibration, such that a force can be obtained by summarizing cross products of magnetic lines of force from the S poles of the magnetic members 127*a* and 127*b* and electric currents at opposite end portions of the coil 126. Here, the direction of electric current at the central part of the coil 126 is opposite to the direction of electric current at the opposite end portions of the coil 126, and magnetic lines of force in the N pole side of the magnetic members 127*a* and 127*b* are directed opposite to magnetic lines of force in the S pole sides of the magnetic members 127*a* and 127*b*, such that the resultant force is generated in one direction. FIG. 7C shows the directions of the magnetic lines of force, the electric currents and the resultant force, which are generated by the coil 126 and the magnetic members 127*a* and 127*b*.

Furthermore, as shown in FIG. 7B, a corrugated part 124*a* can be formed in the outer circumference of the diaphragm 124 so as to amplify vibration.

In the vibrating unit 120 as described above, when electric current is applied to the coil 126, a pair of the magnetic members 127*a* and 127*b* vibrate in horizontal directions, and the vibration is transmitted through the vibration-transmitting member 125 to the diaphragm 124.

Although not illustrated in the drawings, the coil 126 wound on the inner wall of the tubular member 110 can form an outer wall by itself without the use of the housing 121. That is, the coil 126 may be wound in a position of the housing 121 to thereby form the outer wall.

The middle ear implantable hearing device having a tubular vibration transducer to drive a round window described as above has the following advantageous effects.

Firstly, unlike the existing conventional methods, in which the tube and the vibrator are separately located and are then connected to each other, the miniature vibrator is installed inside the tubular member. According to this type of middle ear implantable transducer, overall gain and high frequency attenuation are small, and an implant operation can be easily performed. Since sound can be inputted to the round window, sound delivery effect is much higher. It is also possible to minimize difficulties associated with and problems resulting from the operation, which the conventional methods would have. Further, the transducer can have a relatively larger size, and thus be easily fabricated.

Secondly, the middle ear implantable hearing device of the present invention can be applied to a patient with sensorineural hearing loss whose ossicle is damaged. Further, since sound is directly transmitted without through the ear drum and the ossicle, high efficiency sound delivery is achievable and hearing loss compensation are easy.

While the present invention has been described with reference to the particular illustrative embodiments and the accompanying drawings, it is not to be limited thereto but will be defined by the appended claims. It is to be appreciated that those skilled in the art can substitute, change or modify the embodiments in various forms without departing from the scope and spirit of the present invention.

What is claimed is:

1. A middle ear implantable hearing device comprising:

a microphone detecting sound from outside;

a signal processing unit amplifying the sound received from the microphone;

a hollow tubular member with a first portion thereof coupled to the signal processing unit and a second portion thereof adapted to be inserted into an opening of a round window in an inner ear of a human body;

a vibrating unit disposed inside the tubular member so as to generate mechanical vibration signals or sound signals in response to electric signals from the signal processing unit; and, a signal cord disposed inside the tubular member, wherein the signal cord is connected at a first end portion thereof to the signal processing unit and at a second end portion thereof to the vibrating unit, on as to transmit the electric signals from the signal processing unit to the vibrating unit, wherein the tubular member comprises:

a cord-storing part, housing the signal cord therein;

a vibrator-storing part integrally extending from the cord-storing part; and, a vibration-transmitting part integrally extending from the vibrator-storing part, wherein the vibration-transmitting part has a close flared distal end, which is configured to allow air or liquid to enter, wherein the vibration-transmitting part has a tapered cross-sectional shape that narrows to the distal end, wherein the close flared distal end of the vibration-transmitting part forms a membrane surface that contacts a round window membrane.

2. The middle ear implantable hearing device according to claim 1, wherein the vibration-transmitting part further has a funnel-shaped bushing polymer ring on the distal end, the bushing polymer ring being flexible and biocompatible.

3. A middle ear implantable hearing device comprising:

a microphone detecting sound from outside;

a signal processing unit amplifying the sound received from the microphone;

a hollow tubular member with a first portion thereof coupled to the signal processing unit and a second portion thereof adapted to be inserted into an opening of a round window in an inner ear of a human body;

a vibrating unit disposed inside the tubular member so as to generate mechanical vibration signals or sound signals in response to electric signals from the signal processing unit: and, a signal cord disposed inside the tubular member, wherein the signal cord is connected at a first end portion thereof to the signal processing unit and at a second end portion thereof to the vibrating unit, so as to transmit the electric signals from the signal processing unit to the vibrating unit, wherein the tubular member comprises:

a cord-storing part, housing the signal cord therein;

a vibrator-storing part integrally extending from the cord-storing part; and, a vibration-transmitting part integrally extending from the vibrator-storing part, wherein the vibration-transmitting part has an open flared distal end, the tubular member further comprises a porous filter placed inside the distal end so as to prevent foreign materials from entering, the vibration-transmitting part has a tapered cross-sectional shape that narrows to the distal end, and the open flared distal end of the vibration-transmitting part corresponds to a round window membrane.

4. The middle ear impantable hearing device according to claim wherein the vibrating unit comprises:

a housing disposed inside the tubular member and having a through-hole in a first end thereof, through which the signal cord is inserted;

first and second electrodes disposed inside the housing and connected to the signal cord;

at least one layer of piezoelectric element disposed between the first and second electrodes;

a diaphragm coupled to a second end of the housing so as to be vibrated by the piezoelectric element; and vibration-transmitting member disposed between the piezoelectric element and the diaphragm so as to transmit vibration from the piezoelectric element to the diaphragm.

5. The middle ear implantable hearing device according to claim 1, wherein the vibrating unit comprises:

a housing disposed inside the tubular member;

a coil wound on an inner circumferential portion of the housing and connected to the signal cord;

a pair of opposing magnetic members disposed inside the housing;

a vibration-controlling membrane coupled to a first end of the magnetic member;

a diaphragm coupled to a first end of the housing so as to vibrate in response to a pair of the magnetic members; and a vibration-transmitting member interposed between the magnetic member and the diaphragm so as to transmit vibration, generated by the coil and the magnetic members, to the diaphragm.

6. The middle ear implantable hearing device according to claim 5, wherein the diaphragm has a corrugated part in a circumferential portion thereof so as to amplify vibration.

7. The middle ear implantable hearing device according to claim 4, wherein the diaphragm has a corrugated part in a circumferential portion thereof so as to amplify vibration.

8. The middle ear implantable hearing device according to claim 3, wherein the vibrating unit comprises:

a housing disposed inside the tubular member and having a through-hole in a first end thereof, through which the signal cord is inserted;

first and second electrodes disposed inside the housing and connected to the signal cord;

at least one layer of piezoelectric element disposed between the first and second electrodes;

a diaphragm coupled to a second end of the housing so as to be vibrated by the piezoelectric element; and, a vibration-transmitting member disposed between the piezoelectric element and the diaphragm so as to transmit vibration from the piezoelectric element to the diaphragm.

9. The middle ear implantable hearing device according to claim 3, wherein the vibrating unit comprises:

a housing disposed inside the tubular member;

a coil wound on an inner circumferential portion of the housing and connected to the signal cord;

a pair of opposing magnetic members disposed inside the housing;

a vibration-controlling membrane coupled to a first end of the magnetic member;

a diaphragm coupled to a first end of the housing so as to vibrate in response to a pair of the magnetic members; and, a vibration-transmitting member interposed between the magnetic member and the diaphragm so as to transmit vibration, generated by the coil and the magnetic members, to the diaphragm.

10. The middle car implantable hearing device according to claim 8, wherein the diaphragm has a corrugated part in a circumferential portion thereof so as to amplify vibration.

11. The middle ear implantable hearing device according to claim 9, wherein the diaphragm has a corrugated part in a circumferential portion thereof so as to amplify vibration.

* * * * *